United States Patent [19]

Kobayashi

[11] 4,252,075

[45] Feb. 24, 1981

[54] WATER JET PROPULSION SYSTEM WITH LATERALLY DISPOSED REVERSE PORTS

[75] Inventor: Yoshiaki Kobayashi, Hamamatsu, Japan

[73] Assignee: Yamaha Hatsudoki Kabushiki Kaisha, Iwata, Japan

[21] Appl. No.: 69,049

[22] Filed: Aug. 23, 1979

Related U.S. Application Data

[63] Continuation of Ser. No. 843,689, Oct. 19, 1977, abandoned.

[30] Foreign Application Priority Data

Oct. 28, 1976 [JP] Japan ..... 51-129648
Jul. 19, 1977 [JP] Japan ..... 52-96260

[51] Int. Cl.[3] ..... B63H 11/10

[52] U.S. Cl. ..... 440/42; 60/222; 60/230; 239/265.27; 440/43

[58] Field of Search ..... 115/11, 12 R, 12 A, 115/14, 15, 16; 114/150, 151; 239/265.25, 265.27; 60/221, 222, 229, 230

[56] References Cited

U.S. PATENT DOCUMENTS

| | | | |
|---|---|---|---|
| 3,212,258 | 10/1965 | Gongwer | 115/16 |
| 3,266,242 | 8/1966 | Aschauer | 115/12 R |
| 3,384,306 | 5/1968 | Hanley | 115/12 R |
| 3,824,946 | 7/1974 | Macardy et al. | 115/12 R |
| 3,842,787 | 10/1974 | Giacosa | 115/12 A |
| 4,004,541 | 1/1977 | Onal | 115/12 R |

FOREIGN PATENT DOCUMENTS

| | | | |
|---|---|---|---|
| 232049 | 11/1968 | U.S.S.R. | 115/12 R |

*Primary Examiner*—Charles E. Frankfort
*Attorney, Agent, or Firm*—Donald D. Mon

[57] ABSTRACT

A water jet propulsion system for use with boats having an impeller duct which discharges a stream of liquid through a nozzle to propel the vessel in a forward direction. A reversal plate is provided which occludes the rearward jet opening and causes the stream to exit through a pair of reverse movement ports, one disposed on each side of the nozzle to direct the water jet from the impeller duct forwardly and preferably also slanted downwardly when the boat is to be reversed.

12 Claims, 6 Drawing Figures

WATER JET PROPULSION SYSTEM WITH LATERALLY DISPOSED REVERSE PORTS

This is a continuation, of application Ser. No. 843,689, filed Oct. 19, 1977, now abandoned.

This invention relates to water jet propulsion systems capable of propelling a vessel in either the forward or the reverse direction.

Water jet propulsion systems are well-known. They are characterized by an impeller duct which draws in water from near the stern of the boat, accelerates it, and expels it through a nozzle that is pointed rearwardly to drive the vessel forwardly. It is also known to reverse the direction of the exiting jet stream in order to propel the boat rearwardly. The previously known devices have had the disadvantage that they project below the bottom of the boat where they strike rocks or shoals. Also some of their designs comprise a continuous obstruction to forward movement.

Also, some of their designs result in a recirculation of a water and air mixture to the propulsion system, whereby to lower the propulsion efficiency.

It is an object of this invention to provide reversal means for a water jet propulsion system wherein the reversal mechanism provides minimal obstruction to forward flow and, which does not project below the bottom of the boat, and which can direct the exit stream away from the intake to prevent recycling of a water and air mixture.

A water jet propulsion system according to this invention comprises an impeller duct and an exit nozzle. The exit stream is steerable from right to left. A reversal plate is provided which moves upwardly and downwardly to occlude or leave open the steering nozzle, and reversal ports are formed on both sides of the steering nozzle, which lead forwardly, and which preferably slant downwardly.

Figure 1A:
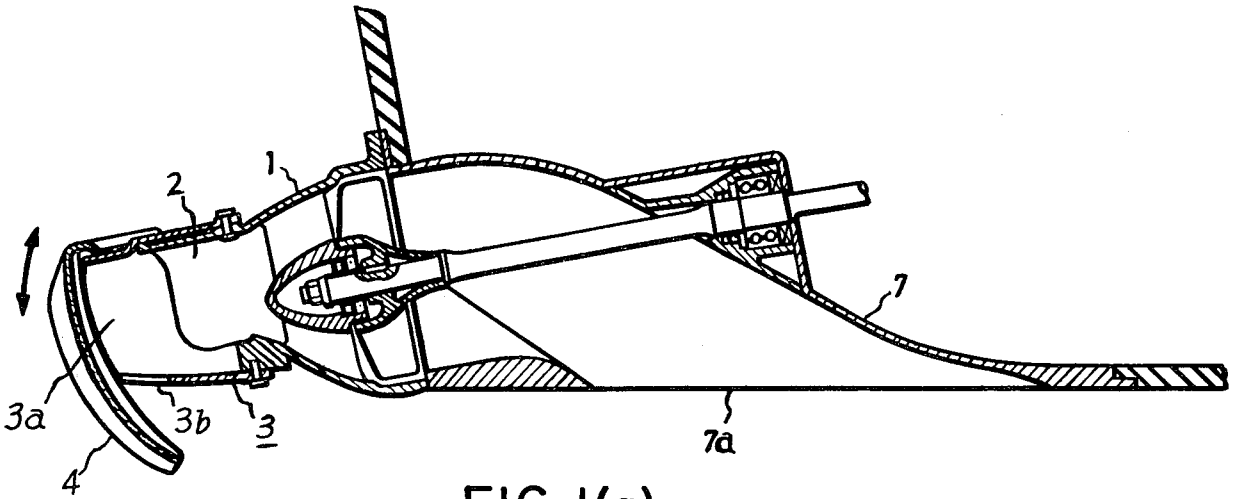
Figure 1B:
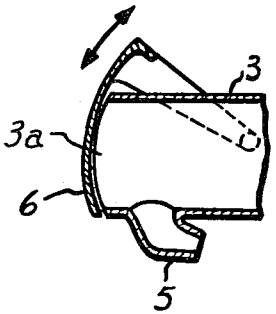
Figure 2B:
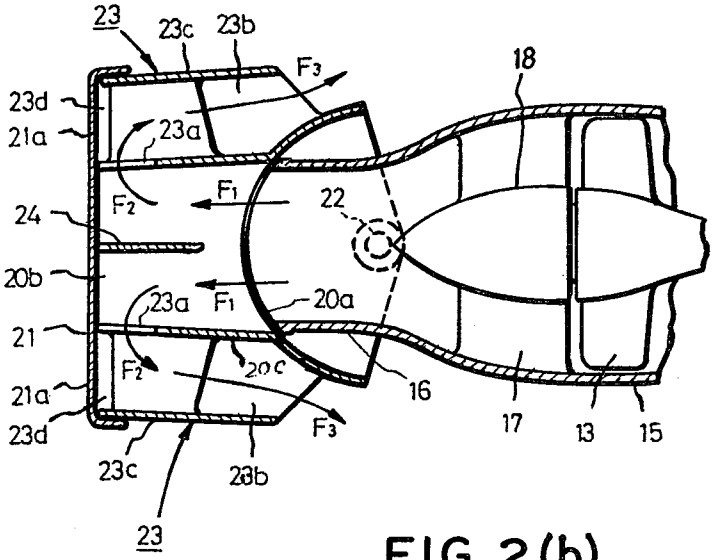
Figure 2A:
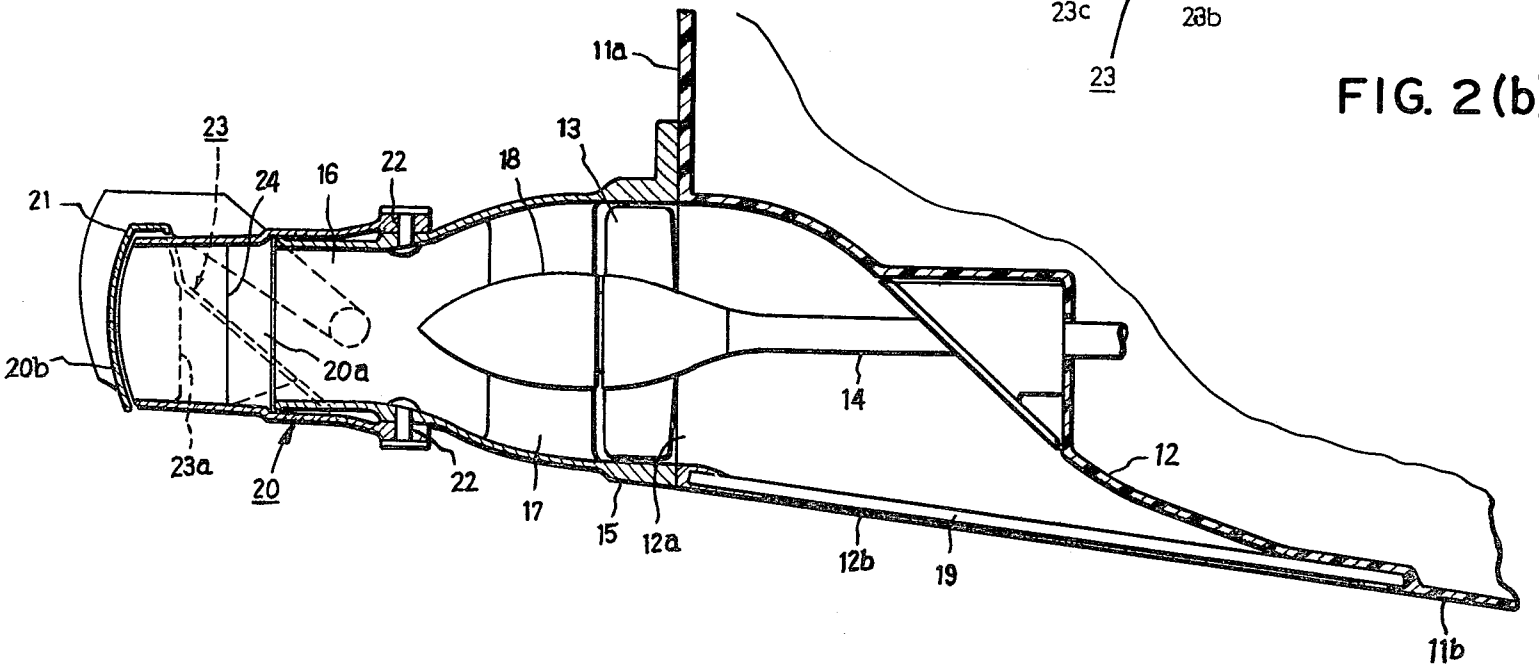

The above and other features of this invention will be fully understood from the following detailed description and the accompanying drawings in which:

FIG. 1*a* is a vertical longitudinal cross-section showing a prior art device;

FIG. 1*b* is a fragmentary section showing another prior art device;

FIG. 2*a* is a longitudinal cross-section of one embodiment of this invention;

FIG. 2*b* is a section looking downwardly in FIG. 2*a;*

Figure 3A:
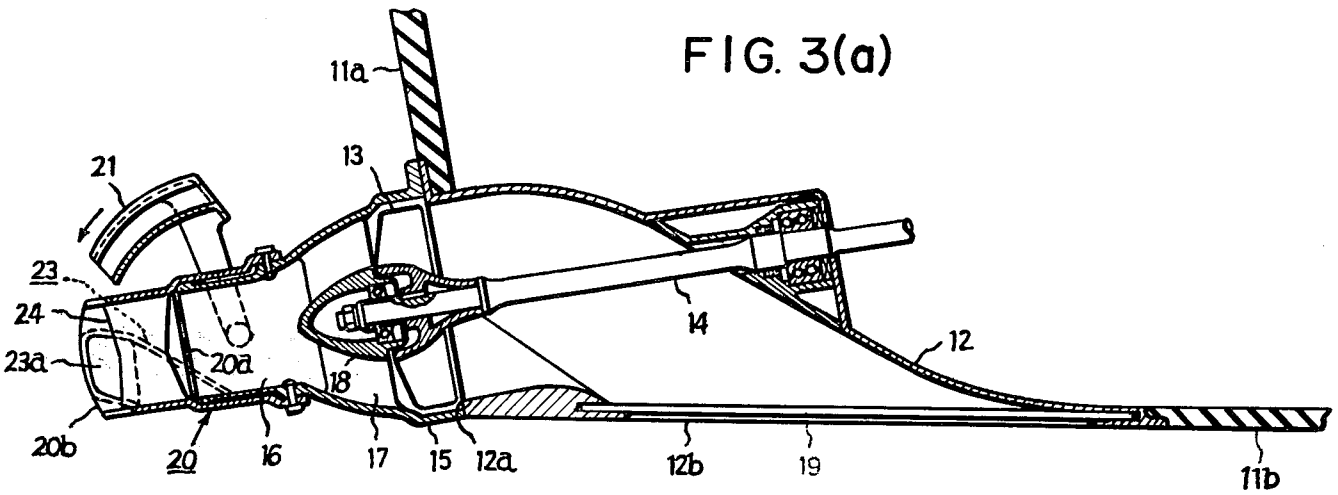
Figure 3B:
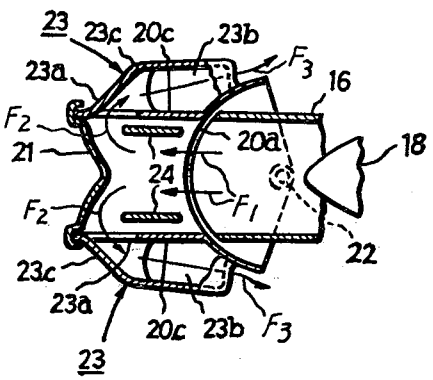

FIG. 3*a* is a longitudinal axial cross-section of another embodiment of the invention; and FIG. 3*b* is a horizontal section looking downwardly in FIG. 3*a*.

A known prior art construction is shown in FIG. 1*a*, wherein an exit nozzle 2 is connected to an impeller duct 1. A steering nozzle 3 is mounted to receive the effluent stream from nozzle 2. It can swing from right to left to steer the boat. It has a notch port 3*b* opening downwardly relative to the exit port 3*a* for reverse propulsion. A bucket 4 (reversal plate) opens or closes exit port 3*a*.

FIG. 1*b* shows another prior art construction wherein a forwardly opening reverse nozzle 5 is permanently installed on the lower part of the steering nozzle near exit port 3*a*. A bucket 6 opens or closes exit port 3*a* to provide for forward or reverse propulsion.

In the FIG. 1*a* construction, the tip of bucket 4 is elongated to increase the reverse power by exerting a substantial guidance to the jet stream which issues from notch port 3*b*. Its inherent defect is that it cannot be used in shoal water or where rocks are present, because the bucket may be damaged if it strikes such an obstruction.

In the FIG. 1*b* embodiment, the reverse nozzle 5 not only can be broken off in shoal or rocky water, but also constitutes a continuous resistance to forward movement.

In both prior art constructions neither device can develop optimum efficiency because the jet stream is directed forwardly under the bottom of the vessel below the intake 7*a* of intake duct 7. This stream, which consists of water and air, is easily taken again into the intake duct. This will decrease the output and cause an increase of engine speed on reverse movement.

The device of FIG. 2 illustrates the preferred embodiment of the invention. In this Fig., stern board 11*a* and bottom 11*b* of the vessel are shown. An intake duct 12 opens on the bottom and leads to an impeller 13. A drive shaft 14 linked to an engine (not shown) drives the impeller. Impeller duct 15 surrounds the impeller and receives water from the intake duct. The forward end of the impeller duct is connected to outlet end 12*a* of the intake duct 12. An exit nozzle 16 receives liquid from the impeller duct and is directed axially rearwardly.

A stationary blade 17 extends across the impeller duct and supports a bearing 18 which in turn journally supports the tip of the drive shaft 14. A grating 19 is mounted across intake 12*b* of intake duct 12 to exclude floating material from the system.

A steering nozzle 20 is provided for left and right hand movement to steer the boat. It is mounted to exit nozzle 16. The opening end 20*a* on the intake side of the steering nozzle faces toward the outlet port of nozzle 16 and is coaxial therewith when the boat is to be driven straight forwardly or straight reversely as illustrated in the drawings. The steering nozzle has an exit orifice 20*b* at its discharge end from which propulsion liquid exits. The steering nozzle is mounted to swing from the right to the left by rotation around shaft 22 to steer the boat by "pointing" the exit orifice in an appropriate direction.

A reverse nozzle 23 is provided one on each side of steering nozzle 20 and forms a unitary structure therewith. In the embodiment illustrated in FIGS. 2*a* and 2*b*, the reverse nozzle 23 comprises a reverse jet entry port 23*a* one on each side of the steering adjacent to its exit orifice 20*b*. The reverse nozzle is formed by reverse jet wall members 23*c* which form reverse jet exit ports 23*b*. The reverse nozzles open near the forward and preferably near the lower end of the front part of the steering nozzle, and are directed not only forwardly but also angularly somewhat downwardly so its stream will generally avoid the intake port. Reverse jet relief ports 23*d* are formed by the reverse jet wall members 23*c*. They are positioned where they will be simultaneously opened or closed along with exit orifice 20*b*. Ports 23*a* and 23*b* are adjacent to each other. Wall members 23*c* and ports 23*b* are so constructed and arranged that the water stream which enters reverse jet exit ports 23*d* when the vessel is propelled forwardly does not substantially impinge on walls 23*c*, or impinge on the discharge stream from the steering nozzle orifice.

A current plate 24 is placed perpendicularly in the steering nozzle 20. It is adjacent to the exit orifice and extends a substantial distance forwardly and rearwardly in the nozzle. Its purpose is to minimize flow through ports 23*a* when the boat is being turned while moving generally forwardly.

A reversal plate 21 acts as a fore and aft movement changeover bucket. It is rotatably mounted to the steering nozzle so that it can either leave open or close exit orifice 20*b* of steering nozzle 20. FIGS. 2*a* and 2*b* show the system in reverse operation. Lifting the reversal plate 21 will permit direct flow from the exit orifice and cause forward propulsion.

The technique for backing the vessel consists of closing exit orifice 20*b* by moving reversal plate 21 downwardly, thus changing the jet stream F1 from the nozzle to sideward as shown by arrows F2, because the bucket 21 occludes the exit orifice. The flow is then from reverse jet ports 23*b* forwardly and preferably obliquely downward as shown by arrows F3 by means of guidance of wall member 23*c*.

It will be observed that in this device there is no member which ever projects appreciably below the exit port because the jet streams are disposed and exhaust sidewardly and forwardly on each side of the steering nozzle instead of directly underneath it as in the prior art. Such an effluent stream will avoid the intake 12*b* and will not cause recycling of a mixture of air and water.

FIGS. 3*a* and 3*b* show another embodiment of the invention. Because most of the parts are common either in structure or objective with those in FIGS. 2*a* and 2*b*, like numbers will be used, and their description will not be repeated.

In this embodiment, the primary distinction from that of the embodiment of FIGS. 2*a* and 2*b* is in the precise construction of the reverse porting system, the current plate 24, and the reversal plate 21. In this embodiment, the reverse port 23*a* opens in the side of the steering nozzle wall one on each lateral side and extends forwardly and downwardly to reverse jet ports 23*b*, its rearwardmost wall formed by the structure of the steering nozzle rather than being formed only by the reversal plate when in reverse position. The current plate 24, instead of being a single central plate comprises two perpendicular plates spaced apart laterally in the direction of the flow F1 so as to guide a preponderant portion of the flow centrally of the steering nozzle regardless of its steering position, i.e., whether directly forwardly or to the right or to the left. Also, the reversal plate 21 is bent so as to have an apex near its center and to divide flow F1 into two substantially equal branches F2 when in reversal position, i.e., when in the path of the exit nozzle. Thus, the reversal plate forms an integral part of the reversal porting beginning at the region between it and the outlet ends of current plates 24. When the reversal plate is raised as in FIG. 3*a*, then regardless of the steering position of the steering nozzle, most of the water is directed away from ports 23*a* by plates 24, and passes directly out the exit port of the steering nozzle. This overcomes a disadvantage of the embodiment of FIGS. 2*a* and 2*b* wherein, in the forward propelling condition, some of the flow from the impeller duct tends to enter the reversal nozzle system 23 when the system is turned away from center for steering purposes. This can adversely effect the propulsion efficiency of the system. Also, in the embodiment of FIGS. 3*a* and 3*b*, the reversal plate forms a true portion of the reverse nozzle, while in the embodiment of FIGS. 2*a* and 2*b* it merely forms a plate which only occludes and does not efficiently direct the stream.

The devices as shown provide an optimum device which does not have portions that project below the bottom of the boat or steering nozzle, which can direct the effluent stream away from the intake duct to the system, and which can provide for optimum forward and reverse power.

This invention is not to be limited by the embodiments shown in the drawings and described in the description which are given by way of example and not of limitation, but only in accordance with the scope of the appended claims.

I claim:

1. In combination with a vessel to be propelled forwardly or reversely and steered from side to side by a water jet propulsion system, which includes an intake duct, an axial flow pump type impeller, and an impeller duct, means for directing the effluent stream from the impeller duct comprising:

a steering nozzle receiving the stream from the impeller duct, said steering nozzle including a peripheral wall forming a discharge stream, said steering nozzle having a discharge end with an exit orifice therein, a reverse jet entry port being formed through said peripheral wall at each side thereof, near to said exit orifice, said steering nozzle being mounted relative to said impeller duct for side-to-side swinging movement;

a reverse jet wall member mounted to each side of said steering nozzle, each forming a respective reverse nozzle, each said reverse nozzle including a reverse jet exit port, each said said reverse jet wall member also forming a reverse jet relief port adjacent to each said reverse jet entry port, said exit orifice and said reverse jet relief ports facing generally rearwardly said reverse jet wall members and said reverse jet relief ports being so constructed and arranged that, when they are not occluded and said discharge stream issues from said exit orifice, then liquid which enters said reverse jet exit port as a consequence of forward movement of the vessel primarily passes through said reverse jet relief port without substantial impingement upon said discharge stream; and a reversal plate pivotally mounted to said steering nozzle for up and down movement simultaneously to occlude said exit orifice and said reverse jet relief ports, whereby to direct said discharge stream through said reverse jet entry ports and into said reverse nozzles, or to leave said exit orifice and reverse jet relief ports simultaneously not occluded, whereby to permit said discharge stream to issue from the exit orifice and to permit said liquid which enters said reverse jet exit ports to issue from said reverse jet relief ports, no part of said reversal plate ever depending substantially below said discharge end of said steering nozzle.

2. A combination according to claim 1 in which said reverse nozzles discharge generally forwardly and on a downward and forward slant.

3. A combination according to claim 1 in which the reverse nozzles open at the bottom of the steering nozzle.

4. A combination according to claim 1 in which said reverse jet wall members are disposed out of the paths of said discharge stream.

5. A combination according to claim 1 in which each said reverse jet entry port is directly contiguous to, and continuous with, its respective reverse jet relief port, said reverse jet entry ports being primarily directed sidewardly.

6. A combination according to claim 5 in which said reversal plate, when in its occluding position, closes said reverse jet relief ports and forms part of the boundary of the reverse jet entry ports.

7. A combination according to claim 6 in which a current plate is disposed vertically in said steering nozzle, and extends forwardly and rearwardly to discourage flow of said discharge stream directly toward said reverse jet entry ports when said steering nozzle is disposed other than axially for straight forward or straight rearward propulsion.

8. A combination according to claim 6 in which said reverse jet wall members are disposed out of the paths of said discharge stream.

9. A combination according to claim 8 in which said reversal plate is pivotally mounted for up and down arcuate motion in shear relationship with said exit port and with said reverse jet relief ports.

10. A combination according to claim 9 in which a current plate is disposed vertically in said steering nozzle, and extends forwardly and rearwardly to discourage flow of said discharge stream directly toward said reverse jet entry ports when said steering nozzle is disposed other than axially for straight forward or straight rearward propulsion.

11. A combination according to claim 5 in which said reverse jet wall members are disposed out of the paths of said discharge stream.

12. A combination according to claim 1 in which a current plate is disposed vertically in said steering nozzle, and extends forwardly and rearwardly to discourage flow of said discharge stream directly toward said reverse jet entry ports when said steering nozzle is disposed other than axially for straight forward or straight rearward propulsion.

* * * * *